US012638235B2

(12) United States Patent
Turney et al.

(10) Patent No.: US 12,638,235 B2
(45) Date of Patent: May 26, 2026

(54) OXYGEN LIQUEFIER DESIGN PHASING

(71) Applicant: L'Air Liquide, Société Anonyme pour l'Etude et l'Exploitation des Procédés Georges Claude, Paris (FR)

(72) Inventors: Michael A. Turney, Houston, TX (US); Alain Guillard, Dana Point, CA (US)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 306 days.

(21) Appl. No.: 17/946,407

(22) Filed: Sep. 16, 2022

(65) Prior Publication Data

US 2023/0082208 A1 Mar. 16, 2023

Related U.S. Application Data

(60) Provisional application No. 63/244,800, filed on Sep. 16, 2021.

(51) Int. Cl.

| | |
|---|---|
| ***F25J 1/00*** | (2006.01) |
| ***F25J 1/02*** | (2006.01) |
| ***F25J 3/04*** | (2006.01) |

(52) U.S. Cl.

CPC ..... *F25J 1/0017* (2013.01); *F25J 1/0015* (2013.01); *F25J 1/0211* (2013.01); *F25J 1/0234* (2013.01); *F25J 2210/06* (2013.01); *F25J 2210/40* (2013.01); *F25J 2215/42* (2013.01); *F25J 2215/50* (2013.01); *F25J 2290/12* (2013.01)

(58) Field of Classification Search

CPC ..... F25J 1/0234; F25J 2210/06; F25J 1/0072; F25J 1/0201; F25J 1/0202; F25J 1/0288; F25J 3/04296; F25J 3/04309; F25J 3/04315; F25J 2270/40; F25J 3/04339; F25J 3/04278; F25J 3/04951; F25J 3/04969; F25J 3/04957; F25J 1/0274; F25J 2280/02

See application file for complete search history.

(56) References Cited

U.S. PATENT DOCUMENTS

| | | | | |
|---|---|---|---|---|
| 5,329,776 | A | 7/1994 | Grenier | |
| 5,426,947 | A | 6/1995 | Grenier | |
| 2011/0146343 | A1* | 6/2011 | Ha | F25J 3/04454 62/644 |
| 2011/0197630 | A1* | 8/2011 | Guillard | F25J 3/04812 62/644 |
| 2014/0013798 | A1 | 1/2014 | Le Bot | |
| 2016/0298900 | A1* | 10/2016 | Davidian | F25J 3/04963 |
| 2018/0038638 | A1* | 2/2018 | Guillard | F25J 1/0082 |
| 2018/0142950 | A1* | 5/2018 | Guerif | F25J 3/0429 |
| 2020/0158427 | A1* | 5/2020 | Kong | F25J 3/04793 |
| 2021/0270523 | A1* | 9/2021 | Prosser | F25J 1/0022 |

* cited by examiner

*Primary Examiner* — Jianying C Atkisson
*Assistant Examiner* — Esmeralda Arreguin-Martinez
(74) *Attorney, Agent, or Firm* — Elwood L. Haynes

(57) ABSTRACT

A process for producing liquid oxygen, including, a first operating mode, and a second operating mode. During the first operating mode, the distillation column produces a first flowrate of product liquid oxygen, and a first flow rate of liquid nitrogen product. During the second operating mode, the distillation column produces a second flowrate of product liquid oxygen, and a second flow rate of liquid nitrogen product. Wherein, the second flowrate of product liquid oxygen is greater than the first flowrate of product liquid oxygen.

15 Claims, 6 Drawing Sheets

OXYGEN LIQUEFIER DESIGN PHASING

CROSS REFERENCE TO RELATED APPLICATIONS

This application claims the benefit of priority under 35 U.S.C. § 119 (a) and (b) to U.S. Provisional Patent Application No. 63/244,800, filed Sep. 16, 2021, the entire contents of which are incorporated herein by reference.

BACKGROUND

There is a large industrial demand for the components separated from air. Chemical and petrochemical installations use argon, nitrogen, and oxygen in many processes. Often, as one factor in the economies of scale, an air separation plant is designed to produce a significant percentage of their output in liquid form. Liquid oxygen or liquid nitrogen may be desired by the customers, and as pumping a liquid is more energy efficient, is well suited to demands for higher pressure product. Liquid oxygen, nitrogen, or argon are also easier to transport via truck.

SUMMARY

A process for producing liquid oxygen, including, in a first operating mode, cooling a pressurized inlet air stream in a main heat exchanger, thereby producing a cooled inlet air stream, splitting the cooled inlet air stream into a refrigerant air stream and a distillation stream, and introducing the distillation stream into a distillation column. Also, during the first operating mode warming the refrigerant air stream in the main heat exchanger, thereby producing a warmed refrigerant air stream, expanding the warmed refrigerant air stream in an expansion turbine, thereby producing an expanded refrigerant air stream, and introducing the expanded refrigerant air stream into the main heat exchanger. Also, during the first operating mode heating the expanded refrigerant air stream, thereby producing a first heated refrigerant stream, and discharging the first heated refrigerant air stream as a waste stream. During a second operating mode, cooling a pressurized inlet air stream in the main heat exchanger, thereby producing a cooled inlet air stream, introducing the cooled inlet air stream into the distillation column, and receiving a cold refrigerant air stream from a nitrogen liquefier. Also, during the second operating mode warming the cold refrigerant air stream in the main heat exchanger, thereby producing a warmed refrigerant air stream, expanding the warmed refrigerant air stream in an expansion turbine, thereby producing an expanded refrigerant air stream, and introducing the expanded refrigerant air stream into the main heat exchanger. Also, during the second operating mode heating the expanded refrigerant air stream, thereby producing a second heated refrigerant stream, and returning the second heated refrigerant air stream to the nitrogen liquefier.

During the first operating mode, the distillation column produces a first flowrate of product liquid oxygen, and a first flow rate of liquid nitrogen product. During the second operating mode, the distillation column produces a second flowrate of product liquid oxygen, and a second flow rate of liquid nitrogen product. Wherein, the second flowrate of product liquid oxygen is greater than the first flowrate of product liquid oxygen.

ELEMENT NUMBERS

Figure 1:
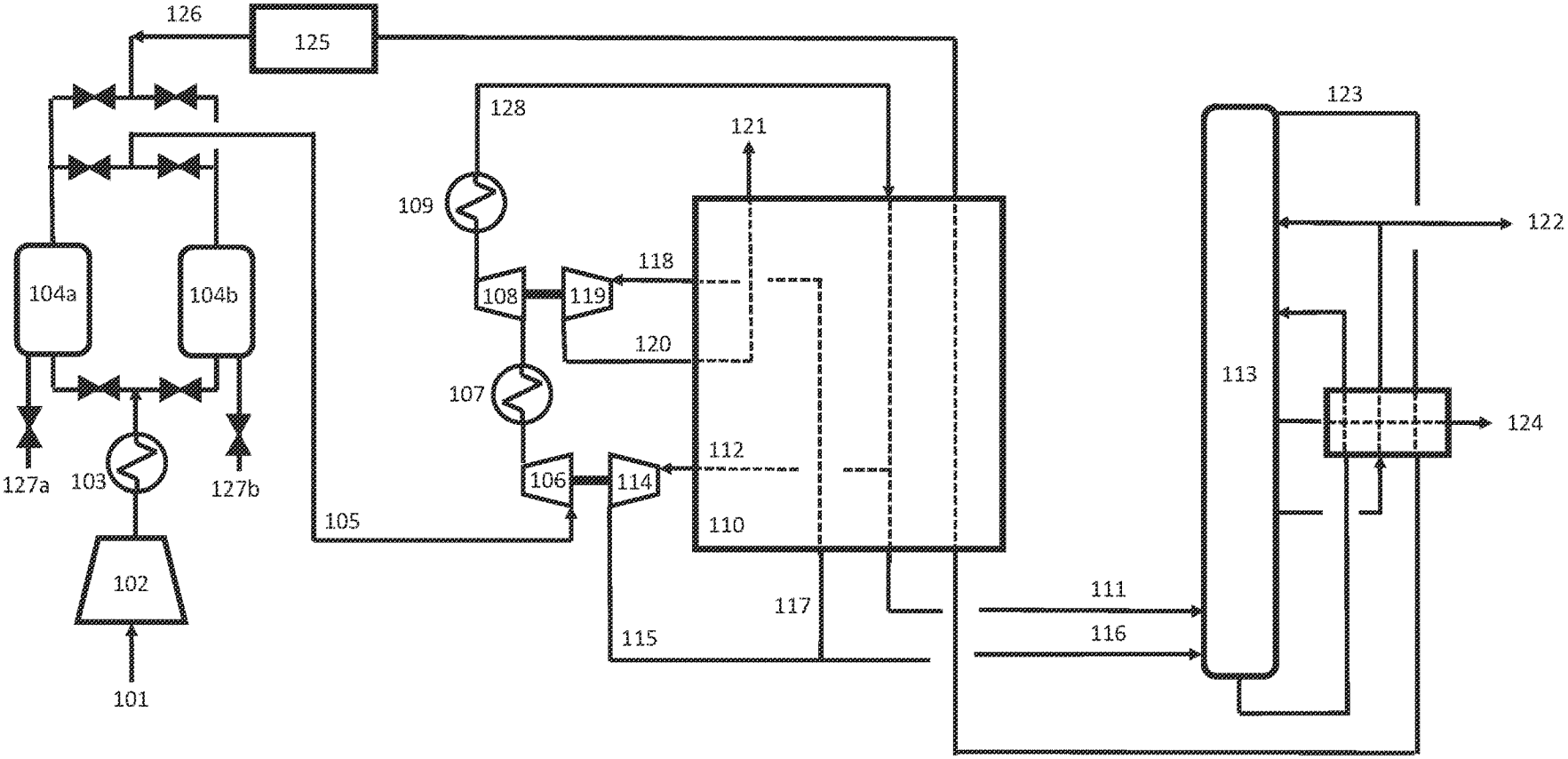
FIG. 1 is a schematic representation of the process scheme during Phase 1, accordance with one embodiment of the present invention.

101=inlet air stream
102=main air compressor
103=inlet air cooler
104*a/b*=air purification vessels
105=purified inlet air stream
106=Claude compressor
107=first boosted air cooler
108=lost air compressor
109=second boosted air cooler
110=main heat exchanger
111=first portion (of cooled inlet air)
112=second portion (of cooled inlet air)
113=distillation column
114=Claude expander
115=cooled inlet air stream
116=distillation stream
117=refrigerant air stream
118=warmed refrigerant air stream
119=expansion turbine
120=expanded refrigerant air stream
121=first heated refrigerant air stream
122=liquid nitrogen product stream
123=first waste nitrogen stream
124=liquid oxygen stream
125=waste nitrogen heater
126=hot waste nitrogen stream
127*a/b*=regeneration waste streams
128=pressurized inlet air stream
201=second waste nitrogen stream
202=warmed second waste nitrogen stream
203=liquefaction heat exchanger
204=cold refrigerant air stream
205=warmed refrigerant air steam
206=expansion turbine
207=expanded refrigerant air stream
208=second heated refrigerant air stream
209=first nitrogen recycle stream
210=low-pressure nitrogen compressor
211=first nitrogen cooler
212=cooled medium-pressure nitrogen stream
213=second nitrogen recycle stream
214=combined medium-pressure nitrogen stream
215=medium-pressure nitrogen compressor
216=second nitrogen cooler
217=cooled intermediate pressure nitrogen stream
218=second high-pressure nitrogen booster
219=third nitrogen cooler
220=first high-pressure nitrogen booster
221=fourth nitrogen cooler
222=cooled high-pressure nitrogen stream

223=first nitrogen refrigeration stream
224=third nitrogen refrigeration stream
225=first nitrogen expander
226=first expanded nitrogen stream
227=first portion (of third nitrogen refrigeration stream)
228=second nitrogen refrigeration stream
229=second nitrogen expander
230=second expanded nitrogen stream
231=third portion (of third nitrogen refrigeration stream)
233=heated refrigerant air stream compressor
234=compressed heated refrigerant air stream

DESCRIPTION OF EMBODIMENTS

Illustrative embodiments of the invention are described below. While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

As used herein, the term "lost air turbine" is defined as a secondary air turboexpander (in addition to a primary air turboexpander) utilized in order to increase the cold production. The secondary turboexpander typically turbo-expands air from approximately 6 bar (a) to atmospheric pressure. This expanded air is usually vented as waste air after being warmed up in the main heat exchanger. The flow of this stream is typically in the range of 20 and 35% of total process air.

Turning now to FIG. 1, the process scheme to be used during Phase 1 is illustrated. Inlet air stream 101 enters main air compressor 102 wherein the pressure is increased, and the pressurized air is cooled in inlet air cooler 103. The cooled, compressed air stream is then directed to one of air purification vessel 104*a/b*, wherein the inlet air stream is purified, thereby producing purified inlet air stream 105. Purified inlet air stream 105 is then compressed in Claude compressor 106 and cooled in first boosted air cooler 107. The cooled and boosted air is then further compressed in lost air compressor 108 and second boosted air cooler 109, thereby producing pressurized inlet air stream 128. Pressurized inlet air stream 128 then enters main heat exchanger 110. First portion 111 of the cooled inlet air exits main heat exchanger 110 and then enters distillation column 113. Second portion 112 of the cooled inlet air exits main heat exchanger 110 and then enters Claude expander 114. The resulting cooled inlet air stream 115 is then split into two fractions: distillation stream 116 and refrigerant air stream 117. Distillation stream 116 then enters distillation column 113. Refrigerant air stream 117 is reintroduced into main heat exchanger 110. Warmed refrigerant air stream 118 then exits main heat exchanger 110 and enters expansion turbine 119, thereby producing expanded refrigerant air stream 120. Expanded refrigerant air stream 120 then reenters main heat exchanger, wherein it is warmed and exits as first heated refrigerant air stream 121, which leaves the system as waste.

Distillation column 113 produces at least liquid nitrogen product stream 122, first waste nitrogen stream 123, second waste nitrogen stream 201, and liquid oxygen stream 124. In order to produce the desired flowrate in liquid oxygen stream 124, it is necessary to introduce additional refrigeration duty, in the form of lost air compressor 108 and expansion turbine 119.

After passing through main heat exchanger 110, first waste nitrogen stream 123 is heated in waste nitrogen heater 125, thereby producing hot waste nitrogen stream 126. Hot waste nitrogen stream 126 is then used to regenerate air purification vessels 104*a/b* as needed, with the resulting regeneration waste exiting in regeneration waste streams 127*a/b*.

Figure 2:
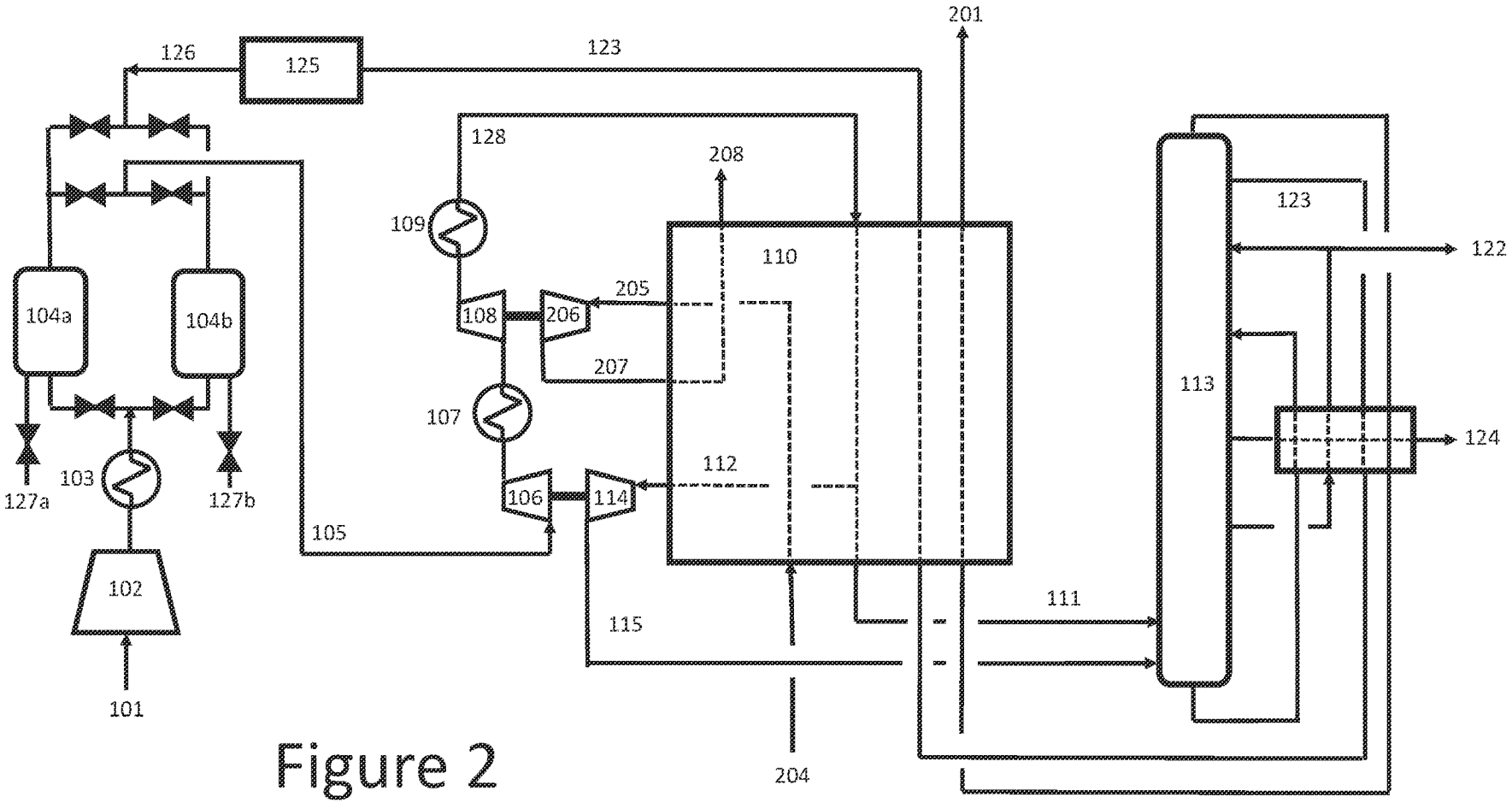
FIG. 2 is a schematic representation of the process scheme during Phase 2, accordance with one embodiment of the present invention.
Figure 3:
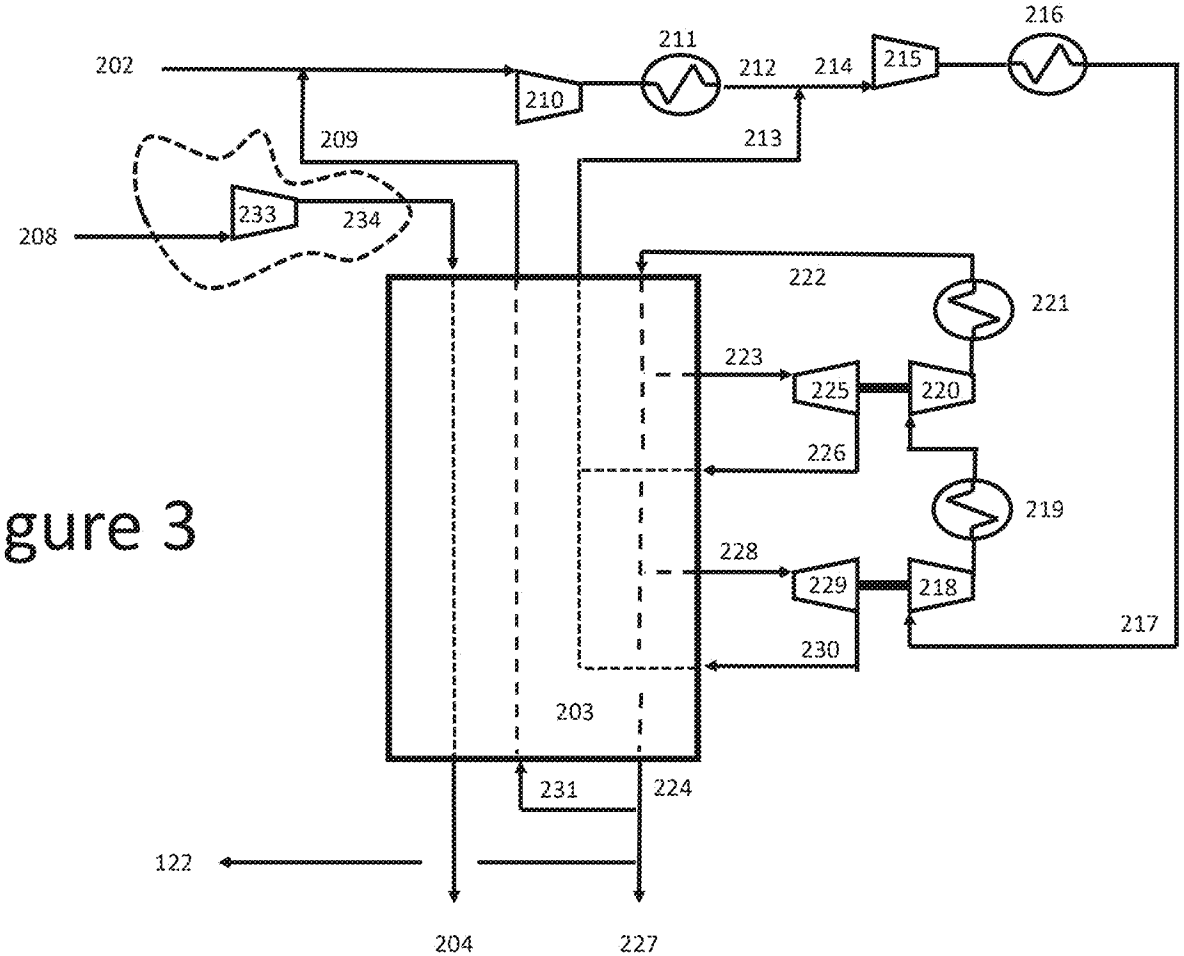
FIG. 3 is a schematic representation of the process scheme during Phase 2, accordance with one embodiment of the present invention.
Figure 4:
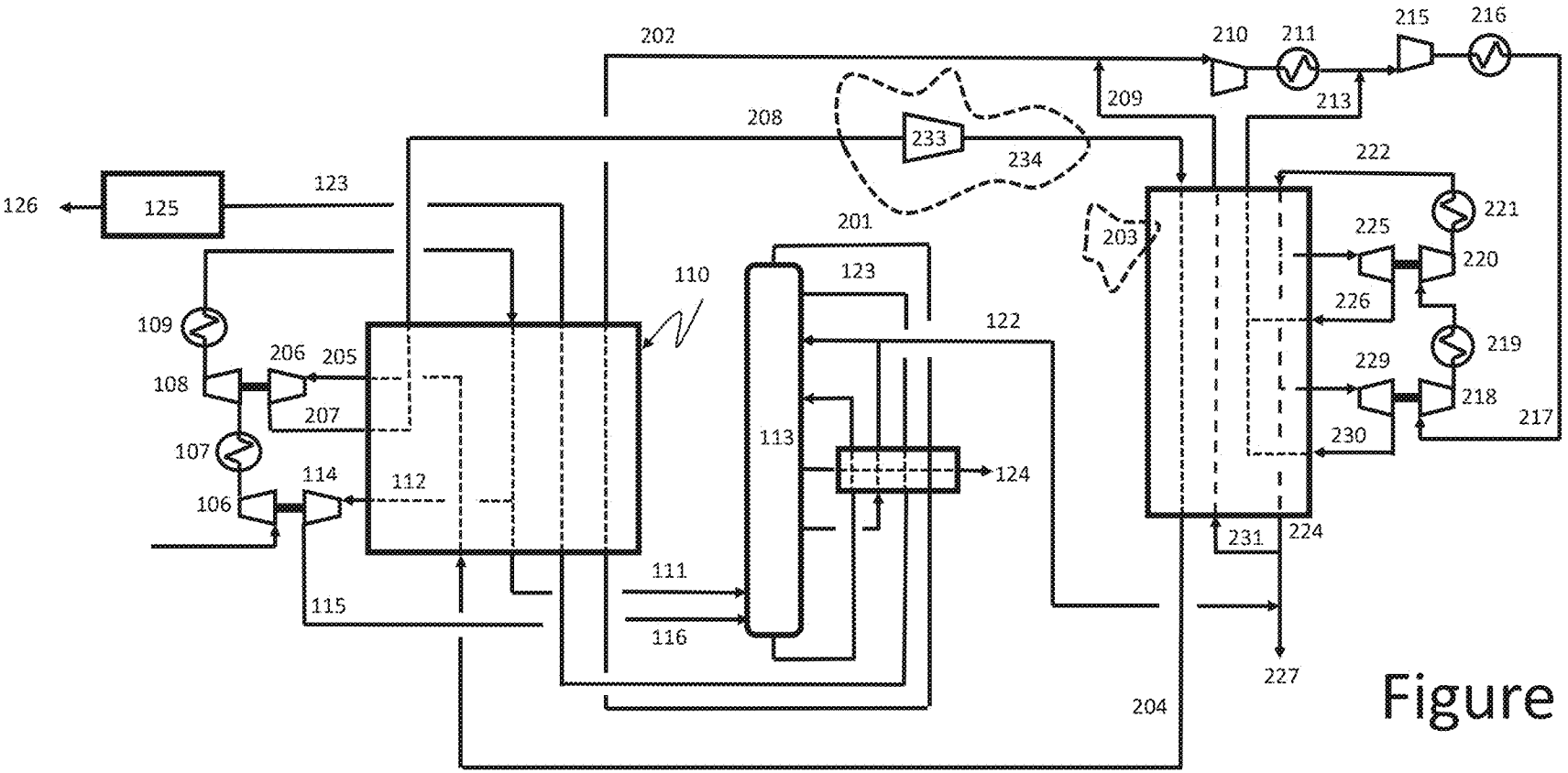
FIG. 4 is a schematic representation of the process scheme during Phase 2, accordance with one embodiment of the present invention.

In the interest of clarity, the process scheme illustrated in FIG. 2, is shown in slightly greater detail in FIGS. 3 and 4. Also in the interest of clarity, streams that maintain the same functionality with that described in FIG. 1 will use the same element numbers.

Turning now to FIGS. 2-4, the process scheme to be used during Phase 2 is illustrated. Inlet air stream 101 enters main air compressor 102 wherein the pressure is increased, and the pressurized air is cooled in inlet air cooler 103. The cooled, compressed air stream is then directed to one of air purification vessel 104*a/b*, wherein the inlet air stream is purified, thereby producing purified inlet air stream 105. Purified inlet air stream 105 is then compressed in Claude compressor 106 and cooled in first boosted air cooler 107. The cooled and boosted air is then further compressed in lost air compressor 108 and second boosted air cooler 109, thereby producing pressurized inlet air stream 128. Pressurized inlet air stream 128 then enters main heat exchanger 110. First portion 111 of the cooled inlet air exits main heat exchanger 110 and then enters distillation column 113. Second portion 112 of the cooled inlet air exits main heat exchanger 110 and then enters Claude expander 114. Cooled inlet air stream 115 then enters distillation column 113.

Distillation column 113 produces at least liquid nitrogen stream 122, first waste nitrogen stream 123, second waste nitrogen stream 201, and liquid oxygen stream 124. In order to produce the desired flowrate in liquid oxygen stream 124 and/or Liquid Nitrogen 122, it is necessary to introduce additional refrigeration duty, in the form of lost air compressor 108 and expansion turbine 119.

After passing through main heat exchanger 110, first waste nitrogen stream 123 is heated in waste nitrogen heater 125, thereby producing hot waste nitrogen stream 126. Hot waste nitrogen stream 126 is then used to regenerate air purification vessels 104*a/b* as needed, with the resulting regeneration waste exiting in regeneration waste streams 127*a/b*.

Second waste nitrogen stream 201 passes through main heat exchanger 110, thereby producing warmed second nitrogen stream 202. Warmed second nitrogen stream 202 is combined with first nitrogen recycle stream 209 and the combined stream has the pressure increased in low-pressure nitrogen compressor 210. The pressurized nitrogen recycle stream then enters first nitrogen cooler 211. Cooled medium-pressure nitrogen stream 212 is combined with second nitrogen recycle stream 213, thereby producing combined medium-pressure nitrogen stream 214. The pressure of combined medium-pressure nitrogen stream 214 is increased in medium-pressure nitrogen compressor 215. The warm intermediate-pressure nitrogen stream then enters second nitrogen cooler 216, thereby producing cooled intermediate-pressure nitrogen stream 217.

Second heated refrigerant air stream 208 is compressed in heated refrigerant air stream compressor 233, thereby producing compressed heated refrigerant air stream 234. Compressed heated refrigerant air stream 234 is then introduced into liquefaction heat exchanger 203, wherein it is cooled, and possibly liquefied, and exits as cold refrigerant air stream 204. Cold refrigerant air stream 204 is reintroduced into main heat exchanger 110, wherein it provides additional refrigeration. Warmed refrigerant air steam 205 then exits main heat exchanger 110 and enters expansion turbine 206. Expanded refrigerant air stream 207 then reenters main heat exchanger, wherein it is warmed and exits as second heated refrigerant air stream 208.

Cooled intermediate-pressure nitrogen stream 217 is then further compressed in second high-pressure nitrogen booster 218. The high-pressure nitrogen stream is cooled in third nitrogen cooler 219. The cooled high-pressure nitrogen is then further compressed in first high-pressure nitrogen booster 220. The further boosted high-pressure nitrogen stream is cooled in fourth nitrogen cooler 221, thereby cooled high-pressure nitrogen stream 222. Cooled high-pressure nitrogen stream 222 then passes through liquefaction heat exchanger 203, after which it is removed at three locations. Typically, first nitrogen refrigeration stream 223 will be removed as a vapor stream, second nitrogen refrigeration stream 228 will be removed as a vapor stream, and third nitrogen refrigeration stream 224 will be removed as a liquid stream.

The first location is via first nitrogen refrigeration stream 223, which is then introduced into first nitrogen expander 225. First nitrogen expander 225 is connected to first high-pressure nitrogen booster 220 by a common drive shaft. After having the pressure reduced in first nitrogen expander 225, this stream exits as first expanded nitrogen stream 226, which is then introduced into liquefaction heat exchanger 203.

The second location is via second nitrogen refrigeration stream 228, which is then introduced into second nitrogen expander 229. Second nitrogen expander 229 is connected to second high-pressure nitrogen booster 218 by a common drive shaft. After having the pressure reduced in second nitrogen expander 229, this stream exits as second expanded nitrogen stream 230, which is then introduced into liquefaction heat exchanger 203.

After having the pressure reduced in first nitrogen expander 225, this stream exits as first expanded nitrogen stream 226, which is then introduced into liquefaction heat exchanger 203. Inside liquefaction heat exchanger 203, first expanded nitrogen stream 226 and second expanded nitrogen stream 230 are combined and exit liquefaction heat exchanger 203 as second nitrogen recycle stream 213.

The third location is via third nitrogen refrigeration stream 224, which is split into three portions. First portion 227 exits the system as product liquid nitrogen. Second portion enters distillation column 113 as nitrogen stream 122. The third portion 231 reenters liquefaction heat exchanger 203 and exits as first nitrogen recycle stream 209.

As used herein, the term "GOK cycle" is defined as a double column air separation process cycle which typically produces an oxygen product at above 13 bars, with inlet air at a pressure of approximately 30 bar, wherein a portion of the cooled air is removed from the main heat exchanger and expanded, thereby producing a more efficient heat transfer between the vaporizing liquid oxygen and the cooling inlet air. Such a system has been disclosed, for example, in U.S. Pat. Nos. 5,329,776 and 5,426,947.

Figure 5:
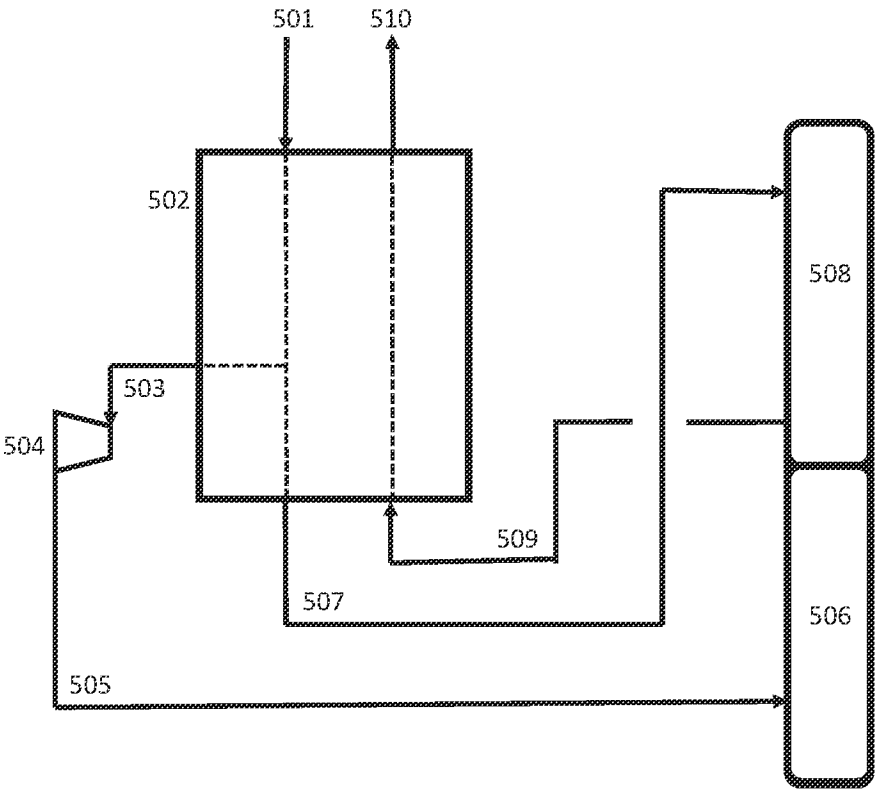
Figure 5 Prior Art
FIG. 5 is a schematic representation of one possible configuration of a GOK cycle, as known in the art.

Turning to FIG. 5, a generic description of the cycle is illustrated. One skilled in the art would recognize that this is a simple representation of one possible GOK cycle, and that other permutations are known. Pressurized and purified feed air stream 501 is introduced into main heat exchanger 502. As the feed air passes through main heat exchanger 502, a first portion 503 is removed at a mid-point and expanded in air expander 504, thereby producing cold expanded air stream 505. Cold expanded air stream 505 is the introduced into medium-pressure column 506. Second portion 507 passes through main heat exchanger 502, then is introduced into low-pressure column 508. Liquid oxygen stream 509 is introduced into main heat exchanger 502, wherein it exchanges heat with pressurized and purified feed air stream 501, is vaporized, and exits main heat exchanger as pressurized gaseous oxygen product stream 510.

As used herein, the term "lost air turbine cycle" is defined as an air separation process which produces a greater amount of liquid oxygen. Such a system has been disclosed, for example in US Published patent application No. 20140013798.

Figure 6:
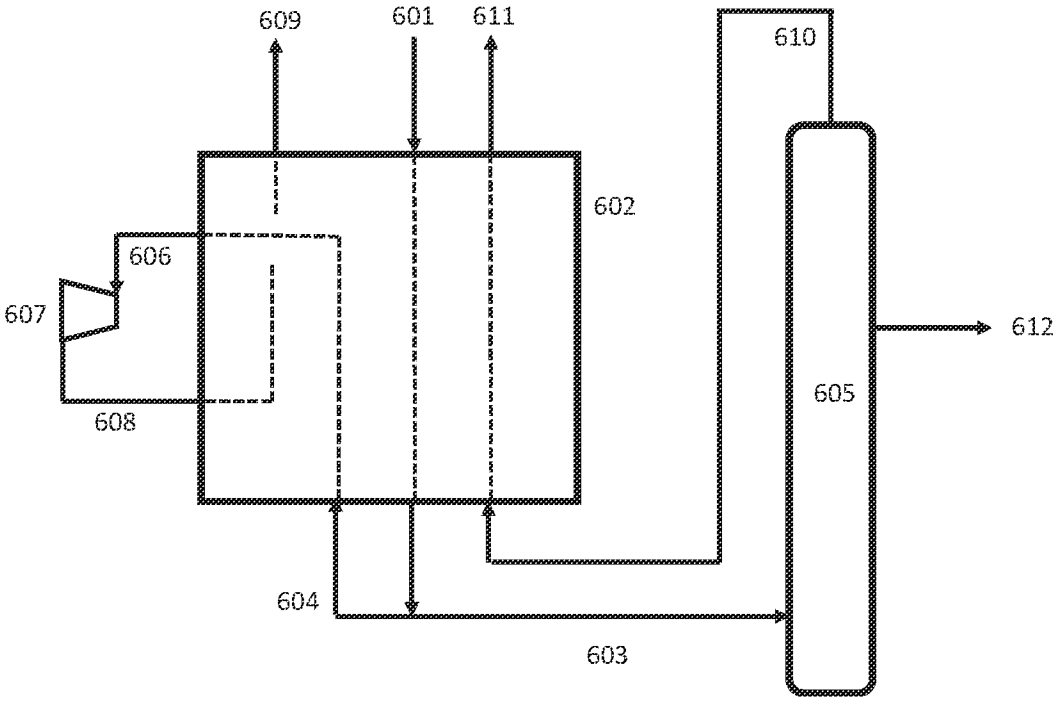
Figure 6 Prior Art
FIG. 6 is a schematic representation of one possible configuration of a Lost Air Turbine cycle, as known in the art.

Turning to FIG. 6, a generic description of the cycle is illustrated. One skilled in the art would recognize that this is a simple representation of one possible lost air cycle, and that other permutations are known. Pressurized and purified feed air stream 601 is introduced into main heat exchanger 602. Feed air passes through main heat exchanger 602 and is divided into a first stream 603 and a second stream 604. First stream 603 is the introduced into distillation column 605. Second stream 604 is reintroduced into main heat exchanger 602 and removed at a mid-point as warm second portion 606. Warm second portion 606 is then expanded in lost air expander 607, thereby producing expanded second portion 608. Expanded second portion 608 is the reintroduced into main heat exchanger 602. Expanded second portion 608 passes through main heat exchanger 602 and exits as lost air stream 609. Waste nitrogen stream 610 is introduced into main heat exchanger 602, wherein it exchanges heat with pressurized and purified feed air stream 601 and exits main heat exchanger as warm waste nitrogen stream 611. Liquid oxygen product stream 612 is removed from distillation column 605

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A process for producing liquid oxygen, comprising:

in a first operating mode, cooling a pressurized inlet air stream in a main heat exchanger, thereby producing a cooled inlet air stream, splitting the cooled inlet air stream into a refrigerant air stream and a distillation stream, introducing the distillation stream into a distillation column, warming the refrigerant air stream in the main heat exchanger, thereby producing a warmed refrigerant air stream, expanding the warmed refrigerant air stream in a first expansion turbine, thereby producing an expanded refrigerant air stream, introducing the expanded refrigerant air stream into the main heat exchanger heating the expanded refrigerant air stream, thereby producing a first heated refrigerant air stream, and discharging the first heated refrigerant air stream as a waste stream, in a second operating mode, cooling the pressurized inlet air stream in the main heat exchanger, thereby producing a cooled inlet air stream, introducing the cooled inlet air stream into the distillation column, receiving a cold refrigerant air stream from a nitrogen liquefier, warming the cold refrigerant air stream in the main heat exchanger, thereby producing a warmed refrigerant air stream, expanding the warmed refrigerant air stream in a second expansion turbine, thereby producing an expanded refrigerant air stream, introducing the expanded refrigerant air stream into the main heat exchanger heating the expanded refrigerant air stream, thereby producing a second heated refrigerant air stream, and returning the second heated refrigerant air stream to the nitrogen liquefier.

2. The process of claim 1, wherein the refrigerant air stream has a first flow rate, a first pressure, a first temperature, and a first enthalpy, the cold refrigerant air stream has a second flow rate, a second pressure, a second temperature, and a second enthalpy, the first heated refrigerant air stream has a third temperature, and a third enthalpy, the second heated refrigerant air stream has a fourth temperature, and a fourth enthalpy.

3. The process of claim 2, wherein the first flow rate is within 15% of the second flow rate.

4. The process of claim 2, wherein the first pressure is within 15% of the second pressure.

5. The process of claim 2, wherein the first temperature is within 15% of the second temperature.

6. The process of claim 2, wherein the third temperature is within 15% of the fourth temperature.

7. The process of claim 2, wherein the first enthalpy minus the third enthalpy multiplied by the first flow rate is within 15% of the second enthalpy minus the fourth enthalpy multiplied by the second flow rate.

8. The process of claim 1, wherein:

during the first operating mode, the distillation column produces a first flowrate of product liquid oxygen, and a first flow rate of liquid nitrogen product, during the second operating mode, the distillation column produces a second flowrate of product liquid oxygen, and a second flow rate of liquid nitrogen product, wherein, the second flowrate of product liquid oxygen is greater than the first flowrate of product liquid oxygen.

9. The process of claim 8, wherein, the second flowrate of liquid nitrogen product is greater than the first flowrate of liquid nitrogen product.

10. The process of claim 9, wherein:

during the first operating mode the distillation column has a first air separation power consumption, and the nitrogen liquefier has a first liquefier power consumption, which combine to produce a first combined power consumption, during the second operating mode the distillation column has a second air separation power consumption, and the nitrogen liquefier has a second liquefier power consumption, which combine to produce a second combined power consumption.

11. The process of claim 10, wherein:

the first flowrate of product liquid oxygen divided by the first combined power consumption produces a first liquid oxygen specific power, the second flowrate of product liquid oxygen divided by the second combined power consumption produces a second liquid oxygen specific power, wherein the first liquid oxygen specific power is within 15% of the second liquid oxygen specific power.

12. The process of claim 10, wherein:

the first flowrate of product liquid nitrogen divided by the first combined power consumption produces a first liquid nitrogen specific power, the second flowrate of product liquid nitrogen divided by the second combined power consumption produces a second liquid nitrogen specific power, wherein the first liquid nitrogen specific power is within 15% of the second liquid nitrogen specific power.

13. The process of claim 1, wherein the distillation column is part of an air separation unit wherein the pressurized inlet air stream has a pressure of greater than 15 bara.

14. The process of claim 1, wherein the nitrogen liquefier utilizes a multicomponent refrigerant system.

15. The process of claim 1 wherein the nitrogen liquefier utilizes a nitrogen expansion refrigerant system.

* * * * *